US007422453B2

(12) United States Patent
Malin

(10) Patent No.: US 7,422,453 B2
(45) Date of Patent: Sep. 9, 2008

(54) SYSTEM AND METHOD FOR CONNECTING SERVICE GROUND WIRE AND COAXIAL DROP CABLE

(75) Inventor: Glen K. Malin, Rye, NY (US)

(73) Assignee: Allied Bolt, Inc., Hollis, NY (US)

( * ) Notice: Subject to any disclaimer, the term of this patent is extended or adjusted under 35 U.S.C. 154(b) by 0 days.

(21) Appl. No.: 11/355,364

(22) Filed: Feb. 16, 2006

(65) Prior Publication Data

US 2007/0190824 A1 Aug. 16, 2007

(51) Int. Cl.
*H01R 4/66* (2006.01)

(52) U.S. Cl. ..... 439/106

(58) Field of Classification Search ..... 439/100, 439/98, 99, 101, 103, 104, 108, 578; 174/78
See application file for complete search history.

(56) References Cited

U.S. PATENT DOCUMENTS 3,621,413 A * 11/1971 Hilbert ..... 439/462
4,461,521 A * 7/1984 Sachs ..... 439/95
4,776,808 A * 10/1988 Davidson ..... 439/100
4,875,864 A * 10/1989 Campbell ..... 439/100
4,993,960 A 2/1991 Franks, Jr.
5,597,314 A * 1/1997 Auclair et al. ..... 439/98
5,722,841 A * 3/1998 Wright ..... 439/98
5,850,056 A * 12/1998 Harwath ..... 174/40 CC
6,548,762 B2 * 4/2003 Jiles et al. ..... 174/78

OTHER PUBLICATIONS

Article 810-Radio and Television Equipment, (810.21), National Electrical Code Handbook (2005): 1142-1143.
Sachs Application Sheet AS-44: Bionding Connection at Meter Pan, publication of Sachs Canada Inc. (1991).
Senior Industries, CATV Installation Overview, pamphlet published by Senior Industries, Inc. (2003).
Allied Bolt, Inc., Coaxial Bonding Connector, pamphlet (2005).
Article 250-Bonding and Grounding, (250.94), National Electrical Code Handbook (2005): 218-221.

* cited by examiner

*Primary Examiner*—Chandrika Prasad
(74) *Attorney, Agent, or Firm*—Baker Botts LLP

(57) ABSTRACT

The present invention provides a system for coupling a coaxial cable with a power ground wire in which a coaxial splice is attached directly to a common service power ground wire via a connector. The direct attachment creates a bonding point that prevents electricity on the drops from entering a building via interior wiring. The connector attaches on one end to a common utility service ground wire. The connector further connects two ends of coaxial drop cable such that the cable is spliced at the point of the connector. This dual bonding results in decreased installation costs due to diminished need for additional ground wire. The dual bonding provides a further advantage in that it reduces the differential in electrical potentials between the power utility and cable television systems. This results in a more direct path to ground and superior electrical characteristics.

12 Claims, 2 Drawing Sheets

SYSTEM AND METHOD FOR CONNECTING SERVICE GROUND WIRE AND COAXIAL DROP CABLE

BACKGROUND OF INVENTION

The present invention relates to techniques for bonding a coaxial drop cable to a common utility service power ground wire.

Installing drop cables at a particular location necessitates a grounding connection to the coaxial cable. Typically, this is accomplished by splicing the coaxial drop cable in conjunction with a ground block and bonding that ground block to an existing grounding electrode system by means of a ground wire. However, this system may be located a significant distance from the installation site of the aerial or underground drop cable. Furthermore, the ground wire may become dislodged or disconnected from the grounding block which may reduce or preclude the grounding effect.

Known ground blocks exist that serve to ground the electrical current from aerial or underground drops. These ground blocks often utilize up to 12 feet of wire in order to reach the ground block, which may become costly and burdensome to the installer. Further, this creates an unnecessary buildup of electrical potential and subsequently increases the risk that electrical current will enter a building via interior wiring. A need therefore exists for a ground block that minimizes the distance, and subsequently the electrical potential, between the wire origin and the grounding connection.

Traditional ground blocks utilize harsh means for securing the ground conductor. This often results in damage to the ground wire, which in turn impairs the function of the ground block system and increases the risk of electrification. It frequently occurs that the ground wire becomes scored or deformed by mechanisms designed to hold the ground wire in place at the point of bonding. A need therefore exists for a ground block that firmly secures the ground wire in order to allow for a superior ground connection without causing damage to the sheath of the wire.

Additionally, known ground blocks are manufactured from steel, aluminum, or stainless steel. These metals are not as conductive as other types of metal in the brass/bronze family. Therefore, a need exists for the construction of a ground block from an ideal grounding material for grounding a copper wire, such as silicon bronze or brass, which have a more comparable electric potential.

Known ground blocks are cumbersome and aesthetically unpleasant. Traditional grounding systems often require mounting screws and elaborate connection devices. Furthermore, conventional ground blocks are not suitable for placement in tight confines such as utility boxes and underground pedestals. A need therefore exists for a ground block that is small in size and simple in design.

U.S. Pat. No. 4,993,960 to Franks, Jr. discloses a system for grounding a telephone system and an electrical power system whereby a clamp is directly secured to an electrical meter box and connected through a grounding connection to the telephone interface box. However, the telephone grounding system involves the use of a cumbersome clamping mechanism attached directly to the electrical utility box to provide an electrical ground. Furthermore, the patent does not address the need for a system of efficiently bonding a power ground wire to a coaxial cable supplying telecommunications input to a building without the use of additional ground wire.

SUMMARY OF THE INVENTION

An object of the present invention is to overcome the disadvantages of the prior art by providing techniques for connecting a coaxial drop cable with a common utility power ground wire, such as that which grounds the utility meter box.

In order to meet this and other objects of the present invention which will become apparent with reference to further disclosure set forth below, the present invention provides a connector for use in bonding coaxial cable directly to a power ground wire, thereby alleviating the need for a separate ground wire. In accordance with an exemplary embodiment of the present invention, the connector is adapted to attach directly to the power utility ground using an open circular gripping mechanism. The connector is further adapted to connect a spliced coaxial drop cable. Since the connector of the present invention reduces the differential in electrical potentials between the two systems, the risk of entry of electrical current in the interior wiring of a structure is greatly reduced.

Additionally, the connector in this exemplary embodiment eliminates a ground wire run, thereby decreasing the costs associated with installation. The connector is designed to hold the common utility service wire at one of its ends while simultaneously facilitating the coaxial ends to come together through the body of the connecting device.

Furthermore, in accordance with an exemplary embodiment of the present invention, a ground wire may be held firmly in the connector without scoring or deforming of the conductor. The present invention operates using a clamping action to firmly secure a ground wire without resultant damage to the wire. This prevents loss of electrical conductivity in the ground wire, thereby further improving the efficiency of the grounding of the electrical current.

Finally, the use of silicon bronze or brass components prevents conflict between various types of metal and improves electrical dissipation due to its enhanced electrical conduction relative to conventional ground block media. The small size of the connector allows for its placement in locations such as residential electrical boxes and reduces the need for elaborate and cumbersome connection devices, such as screws.

The accompanying drawings, which are incorporated and constitute part of this disclosure, illustrate preferred embodiments of the invention and serve to explain the principles of the invention.

BRIEF DESCRIPTION OF THE DRAWINGS

Throughout the figures, unless otherwise stated, the same reference numerals and characters are used to denote like features, elements, components, or portions of the illustrated embodiments.

DETAILED DESCRIPTION OF THE INVENTION

Figure 1:
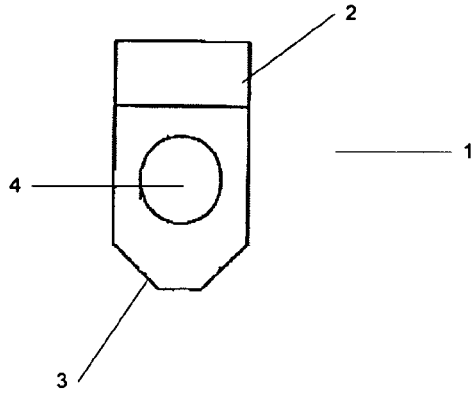
FIG. 1 is a diagram depicting a bottom view of a coaxial bonding connector, in accordance with an exemplary embodiment of the present invention.
Figure 3:
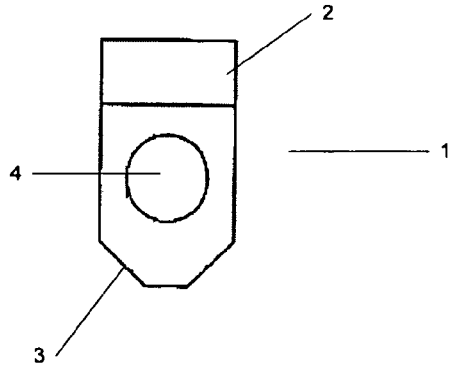
FIG. 3 is a diagram depicting a top view of a coaxial bonding connector, in accordance with an exemplary embodiment of the present invention.

FIGS. 1 and 3 depict a top view and a bottom view respectively, of a coaxial bonding connector in accordance with an exemplary embodiment of the present invention.

A connector 1 is formed from a single strip of conducting material having a first end and a second end. In a preferred embodiment of the present invention, the length of the connector 1 is 1.16 inches, and the width is 0.625 inches. The connector 1 is folded at approximately the midpoint of the strip such that the connector 1 assumes the shape of a clamp. In a preferred embodiment of the present invention, the distance between the two metal strips created by the fold 3 is 0.078 inches, and the thickness of the metal strip is 0.072 inches. The first and second ends of the connector 1 curve to form an open circular end 2 at the open end of the connector 1. The connector 1 further includes a fold 3 opposite said open circular end 2, which may be shaped, for example, by straight edges, but which may alternatively have any other shape suitable for sustaining a fold.

A connector 1 further includes a receiving channel 4. The receiving channel 4 is adapted to accommodate a coaxial splice 5 through the height of the connector 1, which is positioned to facilitate connection with the ends of a coaxial cable. The receiving channel 4 is situated between the open circular end 2 and the fold 3 of the connector 1. In a preferred embodiment of the present invention, the diameter of the receiving channel 4 is 0.406 inches. The distance from the center of the receiving channel 4 to the outermost edge of the fold 3 is 0.513 inches, and the distance from the center of the receiving channel 4 to the outermost edge of the open circular end 2 is 0.647 inches. Those skilled in the relevant art will appreciate that other dimensions will be suitable for other applications, and are within the scope of the present invention.

The connector 1 is manufactured from a material suitable for bonding ground wire 6 and drop cable, and should have proper mechanical and electrical properties in order to ensure connection of the ground wire and drop cable and sufficient grounding thereof, as those skilled in the art will appreciate. Furthermore, the connector 1 should be able to firmly hold in place the ground wire 6 and the coaxial cable 5. In a preferred embodiment of the present invention, the connector 1 possesses a notch 8 attached to one exterior edge that is adapted to secure the coaxial cable 5 in the receiving channel 4. Preferably, the connector 1 is formed from silicon bronze or brass, but may be comprised of any other comparable material, such as any of the yellow metals.

Figure 2:
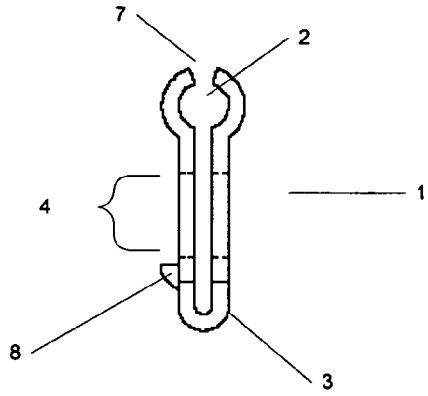
FIG. 2 is a diagram depicting a side view of a coaxial bonding connector, in accordance with an exemplary embodiment of the present invention.

FIG. 2 depicts a side view of a coaxial bonding connector, in accordance with an exemplary embodiment of the present invention. The connector 1 possesses an open circular end 2 that accommodates a ground wire 6. The connector 1 further possesses a fold 3 at the end opposite said open circular end 2. The fold 3 may be shaped by curved edges, but may alternatively be formed in any other shape suitable for sustaining a fold.

Figure 4:
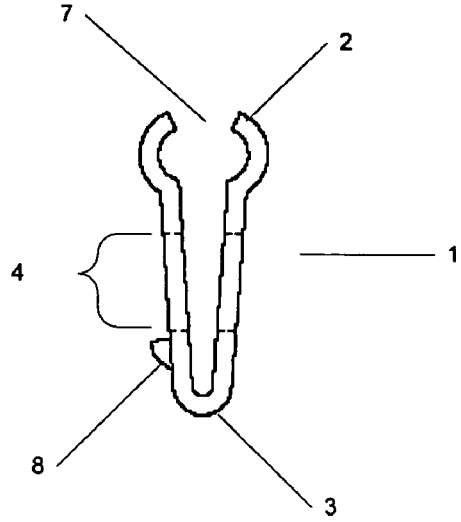
FIG. 4 is a diagram depicting a side view of a coaxial bonding connector in position to receive a ground wire, in accordance with an exemplary embodiment of the present invention.

FIG. 4 is a diagram that depicts a side view of a coaxial bonding connector, in accordance with an exemplary embodiment of the present invention. The connector 1 possesses an opening 7 that, in a preferred embodiment of the present invention, measures in the range of 0.204-0.235 inches. The opening 7 is able to receive a ground wire 6, which passes through the opening 7 and is received in the open circular end 2.

Figure 5:
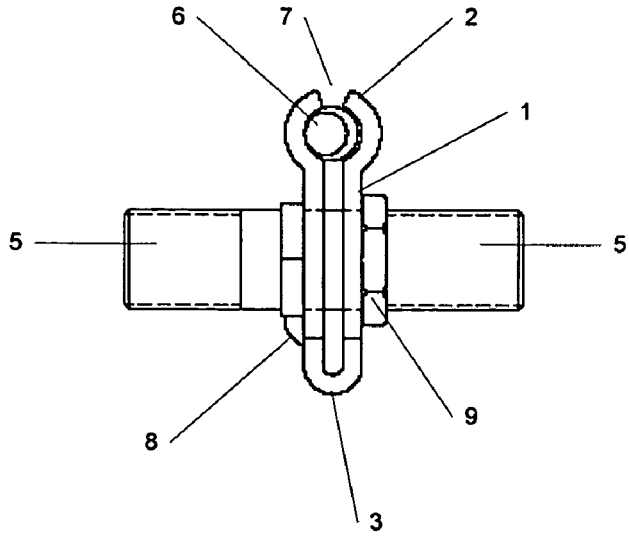
FIG. 5 is a diagram depicting a side view of a coaxial bonding connector in which a ground wire is situated and in which a coaxial splice is placed, in accordance with an exemplary embodiment of the present invention.

FIG. 5 is a diagram that depicts a coaxial bonding connector, in accordance with an exemplary embodiment of the present invention. Upon receipt of a ground wire 6 through the opening 7, the connector 1 may be manually compressed in order to secure the open circular end 2 snugly around a ground wire 6 contained therein.

The receiving channel 4 allows for receipt of a coaxial splice 5 and is positioned between the open circular end 2 and the fold 3 on the connector 1. The coaxial splice 5 traverses the entirety of the connector 1, and portions of the coaxial splice 5 extend outward from the connector 1 following insertion. A hex-shaped portion of the coaxial splice 5 prevents passage of the entire coaxial splice 5 through the receiving channel 4. A notch 8 on one exterior edge of the connector serves to secure the hex-shaped portion of the coaxial splice 5 and prevent turning of the coaxial splice 5 when it is positioned in the receiving channel 4. A nut and washer combination 9 is secured on one end of the coaxial splice 5 adjacent to one side of the connector 1 and on the end opposite that which is secured by the notch 8. The use of a nut and washer combination 9 ensures that the ground wire 6 is securely clamped into the open circular end 2 of the connector 1. The nut and washer combination 9 prevents a ground wire 6 from loosening in the open circular end 2 and thereby preserves the integrity of the ground. A coaxial cable may then be threaded onto either end of the coaxial splice 5 in such a manner as to ensure that the two cables are adequately spliced.

The connector 1 thus serves as a bonding device for the ground wire 6 and the coaxial cable. The coaxial cable is threaded onto the coaxial splice 5 such that, upon installation, the coaxial splice 5 is situated perpendicular to the ground wire 6 secured in the open circular end 2 of the connector 1. The open circular end 2 firmly holds the ground wire 6 in a clamping position without scoring or otherwise deforming the ground wire 6. The connector 1 provides for a direct method of grounding and eliminates the need for additional wire in order to reach a traditional grounding electrode.

The foregoing merely illustrates the principles of the invention. Various modifications and alterations to the described embodiments will be apparent to those skilled in the art in view of the teachings herein. It will thus be appreciated that those skilled in the art will be able to devise numerous techniques which, although not explicitly described herein, embody the principles of the invention and are thus within the spirit and scope of the invention.

I claim:

1. A system for grounding a telecommunications system, comprising:

an existing power ground wire;

a coaxial cable for providing an input into said telecommunications system; and a coaxial bonding connector for coupling said coaxial cable to said power ground wire, comprising a piece of conducting material having first and second ends and folded at a fold point approximately midway therein to form a clamp, wherein said piece possesses regions substantially curved at said first and second ends to form an open circular receiving area for receiving said power ground wire therein, and wherein said piece further includes a receiving channel for receiving a conducting splice for connecting to said coaxial cable, said splice adapted for securing said ground wire to said open circular receiving area of said piece.

2. A coaxial bonding connector for coupling a coaxial cable to a power ground wire, comprising:

a piece of conducting material having first and second ends and folded approximately midway therein to form a clamp;

wherein said piece possesses regions substantially curved at said first and second ends to form an open circular receiving area for receiving said power ground wire therein; and wherein said piece further includes a receiving channel for receiving a conducting splice for connecting to said coaxial cable, said splice adapted for securing said ground wire to said open circular receiving area of said piece.

3. A system as recited in claim 1, wherein said receiving channel is situated between said fold point and said open circular receiving area.

4. A system as recited in claim 1, wherein said piece has a notch on an outer surface of said piece for positioning said splice.

5. A system as recited in claim 1, wherein said piece comprises high strength silicon bronze or brass.

6. A method of coupling a coaxial cable and a power ground wire using a folded piece of conducting material having an open circular receiving area and a receiving channel, comprising the steps of:

(a) inserting said power ground wire into said open circular receiving area of said piece of conducting material, and inserting a coaxial splice into said receiving channel of said piece of conducting material;

(b) manually compressing said piece of conducting material using said coaxial splice such that said power ground wire is securely situated in said open circular receiving area; and (c) attaching said coaxial cable to said coaxial splice.

7. A method as recited in claim 6, wherein said step (a) comprises inserting said coaxial splice such that portions of said coaxial splice substantially extend on either side of said piece of conducting material but said coaxial splice is precluded from traversing the entirety of said piece of conducting material due to a hex-shaped portion of said coaxial splice.

8. A method as recited in claim 7, wherein said hex-shaped portion of said coaxial splice is situated adjacent to a notch formed on said piece of conducting material and thereby prevented from turning when positioned in said piece of conducting material.

9. A method as recited in claim 6, wherein said step (a) comprises placement of a washer and a nut on said coaxial splice substantially extending on either side of said piece of conducting material.

10. A method as recited in claim 9, wherein tightening of said nut on said coaxial splice firmly secures said power ground wire in said open circular receiving area of said piece of conducting material.

11. A method as recited in claim 6, wherein step (c) comprises threading said coaxial cable onto said coaxial splice.

12. A method as recited in claim 6, wherein said coupling of said coaxial cable and said power ground wire is accomplished without using additional ground wire.

* * * * *